US007641194B2

(12) United States Patent
Draxler et al.

(10) Patent No.: US 7,641,194 B2
(45) Date of Patent: Jan. 5, 2010

(54) DRUM FOR CONVEYING A SHEET

(75) Inventors: Daniel Draxler, Heiligkreuzsteinach (DE); Georg Grasmück, Deidesheim (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/875,982

(22) Filed: Oct. 22, 2007

(65) Prior Publication Data

US 2008/0093790 A1 Apr. 24, 2008

(30) Foreign Application Priority Data

Oct. 23, 2006 (DE) ..... 10 2006 049 798

(51) Int. Cl.
*B65H 5/02* (2006.01)

(52) U.S. Cl. ..... 271/277; 271/275; 101/415.1; 101/232

(58) Field of Classification Search ..... 271/277, 271/275; 101/415.1, 232
See application file for complete search history.

(56) References Cited

U.S. PATENT DOCUMENTS

| | | | | | |
|---|---|---|---|---|---|
| 3,926,118 | A | * | 12/1975 | Preuss | 101/246 |
| 5,026,045 | A | * | 6/1991 | Wirz et al. | 271/277 |
| 5,503,072 | A | | 4/1996 | Schneider | |
| 5,673,624 | A | * | 10/1997 | Grundke | 101/415.1 |
| 5,927,198 | A | * | 7/1999 | Tada | 101/232 |
| 7,448,625 | B2 | * | 11/2008 | Forch et al. | 271/277 |

FOREIGN PATENT DOCUMENTS

| | | |
|---|---|---|
| DE | 4326250 C2 | 2/1995 |
| DE | 19741092 C2 | 3/1999 |
| DE | 10249731 A1 | 5/2003 |

* cited by examiner

*Primary Examiner*—Patrick H MacKey
*Assistant Examiner*—Luis Gonzalez
(74) *Attorney, Agent, or Firm*—Laurence A. Greenberg; Werner H. Stemer; Ralph E. Locher

(57) ABSTRACT

A drum for conveying a sheet has a cohesive sheet-guiding surface provided at little effort or cost and includes a drum body, a jacket forming a circumferential surface and a device for fixing the jacket onto the drum body. The jacket is located above a gap formed in the drum body so as to extend parallel to a longitudinal axis. The device for fixing the jacket includes at least one tensioning body that acts on the jacket in the region of the gap and is adjustable in radial direction.

7 Claims, 3 Drawing Sheets

DRUM FOR CONVEYING A SHEET

CROSS-REFERENCE TO RELATED APPLICATION

This application claims the priority, under 35 U.S.C. § 119, of German Patent Application DE 10 2006 049 798.8, filed Oct. 23, 2006; the prior application is herewith incorporated by reference in its entirety.

BACKGROUND OF THE INVENTION

1. Field of the Invention

The invention relates to a drum for conveying a sheet, including a drum body, at least one jacket or backing forming a circumferential surface, at least one device for fixing the jacket onto the drum body, grippers for holding the sheet on the circumferential surface, a device for actuating the grippers, journals for mounting the drum in a frame and a drive for rotating the drum about a longitudinal axis.

In printing press, drums or cylinders equipped with grippers are used to convey sheets. The grippers hold the leading edges of the sheets while the sheets rest on the circumferential surface of a drum. A drum is formed of a drum body with a gap of channel formed therein that accommodates a gripper system. The drum bodies of sheet-guiding impression cylinders are produced by casting. The circumferential surface of the drum is produced by machining in the form of chip removal. In general, the circumferential surface is protected against corrosion by a coating.

For reasons inherent to the printing process, the drum or cylinder may be provided with a jacket. The ends of the jacket are held in clamping devices. The jacket is tensioned or tautened about the cylindrical surface of the drum body in the circumferential direction.

German Published, Non-Prosecuted Patent Application DE102 49 731 A1 discloses a clamping and pulling for a cylinder jacket. The jacket is clamped and pulled tight through the use of a wedge transmission.

In a tensioning device, as it is disclosed in German Patent DE 197 41 092C2, insertion rails are provided at the ends of a jacket for a cylinder in a printing process. For tensioning purposes, the insertion rails are fixed in a tensioning rail. The tensioning rail is adjusted in the redial direction through the use of tensioning screws. Thus, the jacket is tautened on the surface of the cylinder.

German Patent DE 43 26 250 C2, corresponding to U.S. Pat. No. 5,503,072, discloses a device for tensioning a printing blanket on a transfer cylinder. In the device, a blocking device acts on one end of the printing blanket to exert pulling forces in the circumferential direction of the transfer cylinder.

The clamping and tensioning devices proposed by the prior art are costly and complex in terms of the required material. When a sheet is guided through a printing nip under pressure, the drum bodies are cohesive and bend-resistant.

BRIEF SUMMARY OF THE INVENTION

It is accordingly an object of the invention to provide a drum for conveying a sheet, which overcomes the hereinafore-mentioned disadvantages of the heretofore-known devices of this general type and which offers a cohesive sheet-guiding surface with little effort or cost.

With the foregoing and other objects in view there is provided, in accordance with the invention, a drum for conveying a sheet. The drum comprises a drum body, at least one jacket disposed above a gap and forming a circumferential surface, and at least one device for fixing said at least one jacket onto said drum body. The at least one device for fixing is radially adjustable and has at least one tensioning body acting on said at least one jacket in vicinity of said gap. Grippers hold the sheet on said circumferential surface and device actuates said grippers. Journals mount the drum in a frame and a drive rotates the drum about a longitudinal axis.

According to the invention, the gap or other type of hollow space is formed in the drum. The at least one jacket is placed over the gap. The tensioning body pulls the jacket, which is located above the gap, into the gap in the radial direction, thus tensioning or tautening the jacket. The tensioning gap for the jacket preferably extends parallel to the longitudinal axis of the drum and may be provided in addition to a gap that accommodates the grippers for the leading edge of a sheet.

In particular, when large-format sheets are to be conveyed, several backings or jackets may be disposed next to each other in the axial direction of the drum and may be pulled into the tensioning gap through the use of one or more tensioning bodies.

A jacket may have two ends that are fixed on the drum body before the tensioning bodies tension the jacket. The tensioning gap for the jacket is preferably located close to an end of the jacket.

A jacket may also be endless and sleeve-shaped. In this case, the jacket is pushed over the drum body having the tensioning gap before the jacket is tensioned, and the grippers for the sheet edge extend through openings in the jacket.

The tensioning body is preferably a tensioning a profile that rests against the jacket from outside in the region of the tensioning gap and is adjustable in a radially inward direction through the use of tensioning screws.

A particularly light-weight drum is created if ribs are formed on the drum body for the jacket to rest on after tensioning. The aforementioned tensioning gap for the jacket is formed by cut-outs in the ribs. In this embodiment, tensioning screws for pulling a tensioning profile inward in a radial direction are screwed into the ribs.

Other features which are considered as characteristics for the invention are set forth in the appended claims.

Although the invention is illustrated and described herein ad embodied in a drum for conveying a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be understood from the following description of specific embodiments when read in connection with accompanying drawings.

DESCRIPTION OF A PREFERRED EMBODIMENT OF THE INVENTION

Figure 1:
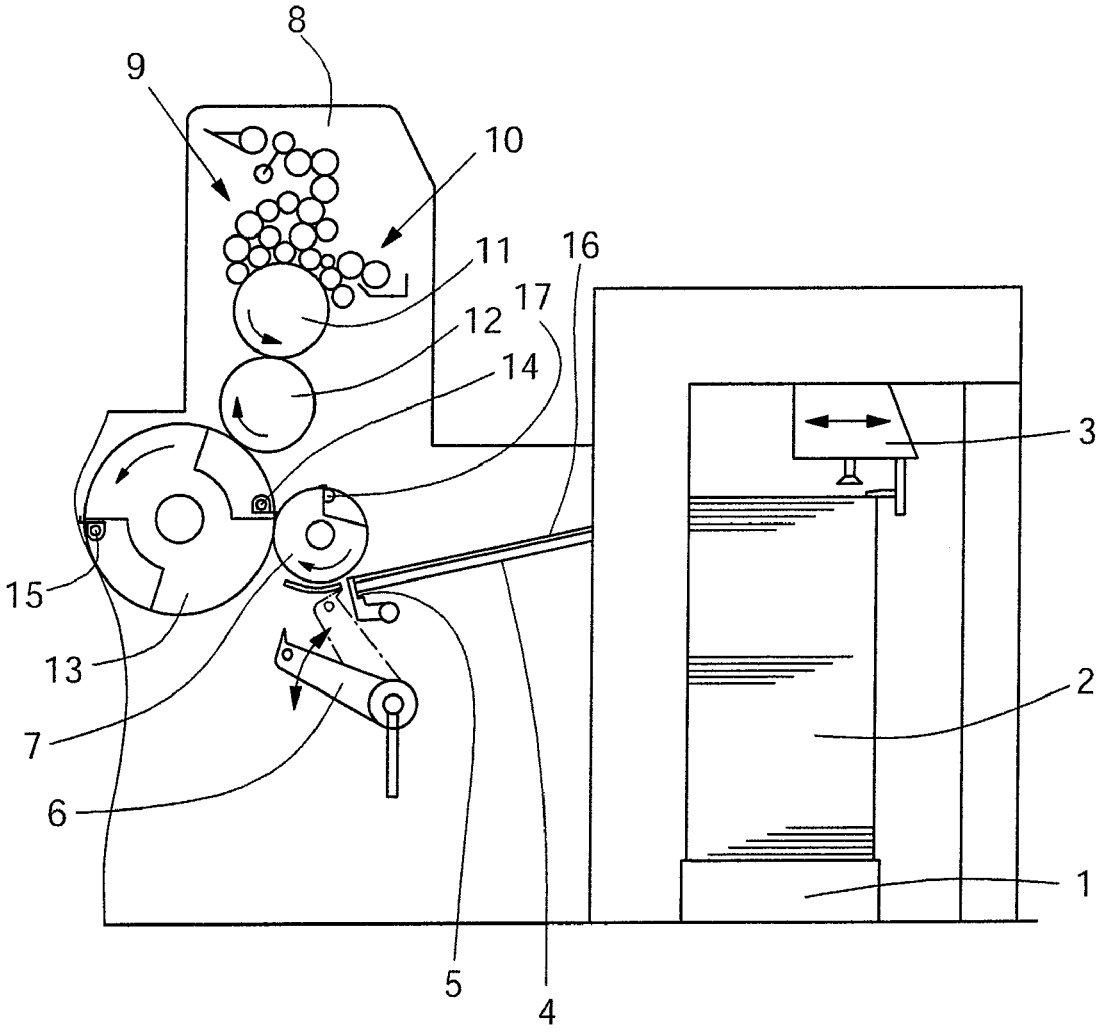
FIG. 1 is a fragmentary, diagrammatic, longitudinal-sectional view of a feeder of a sheet-fed printing press.

Referring now to the figures of the drawings in detail and first, particularly, to FIG. 1 thereof, there is seen a diagrammatic representation of a feeder in a sheet-fed printing press. The feeder includes a platform 1 with a lifting device for lifting a pile 2 toward a suction head 3. In addition, the feeder includes a table 4 with conveying belts for conveying sheets against front guised or lays 5. In the direction of sheet travel, the front guides or lays 5 are followed by oscillating grippers 6 and a feed cylinder 7 for feeding the sheets to a first printing unit 8.

The printing unit 8 includes an inking unit 9, a dampening unit 10, a plate cylinder 11, a transfer cylinder 12, and an impression cylinder 13. The diameter of the impression cylinder 13 is twice the diameter of the plate cylinder 11 or the transfer cylinder 12. The impression cylinder 13 carries two gripper systems 14, 15.

Sheets 16 in the pile 2 are separated from the pile 2 and conveyed to the table 4 through the use of the suction head 3. The leading edge of a sheet 16 resting against the front guides or lays 5 is gripped by the oscillating grippers 6 and transferred to a gripper system 17 of the feed cylinder 7. The sheet 16 is held on the circumferential surface of the feed cylinder 7 and transferred to a gripper system 14, 15 of the impression cylinder 13. The sheet-fed printing press has a drive that rotates the cylinders 7 and 11 to 13 as indicated by arrows.

Figure 2:
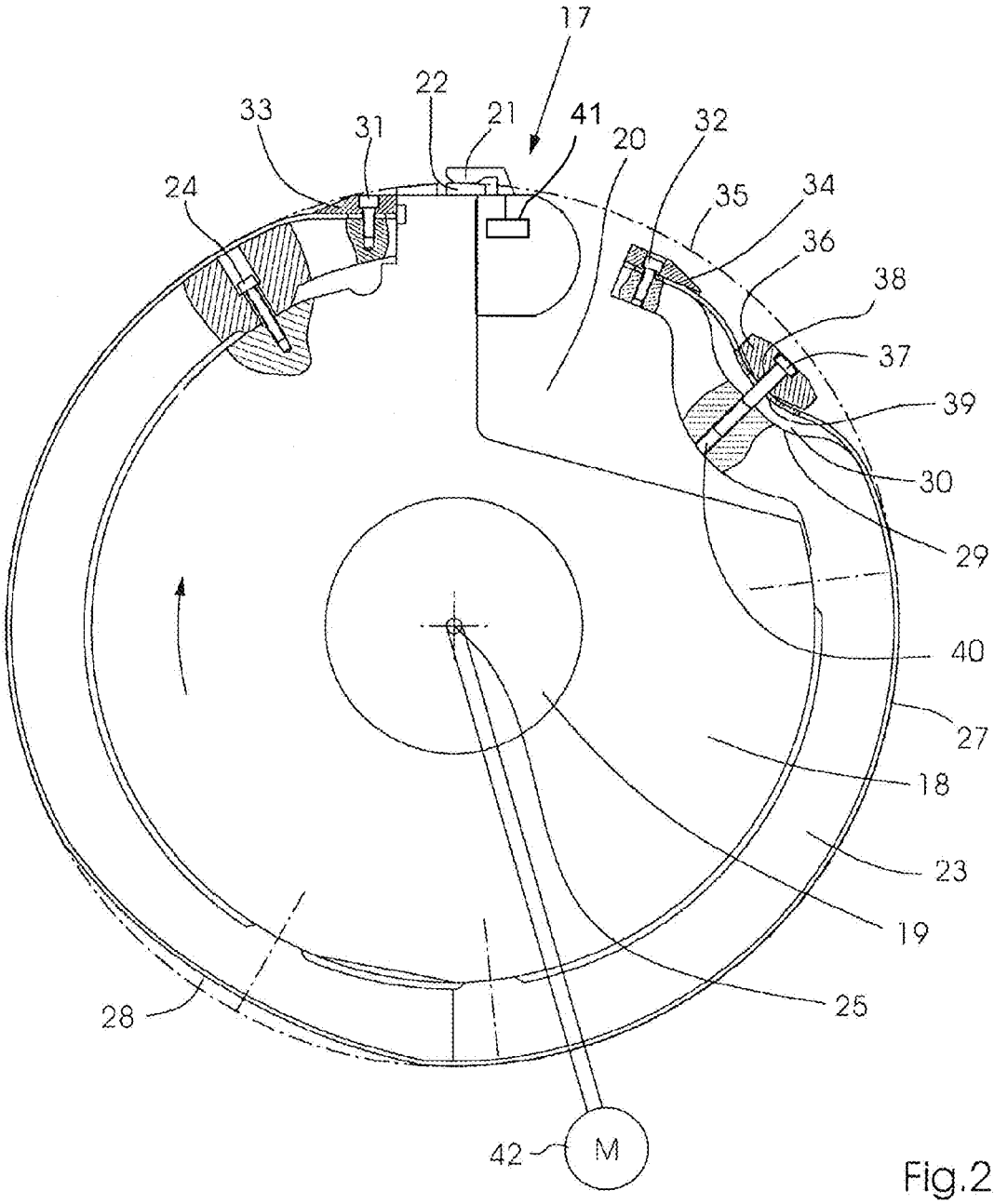
FIGS. 2 and 3 are respective enlarged, partly broken-away sectional and perspective views of a feed cylinder having a tensioning device for a jacket plate.
Figure 3:
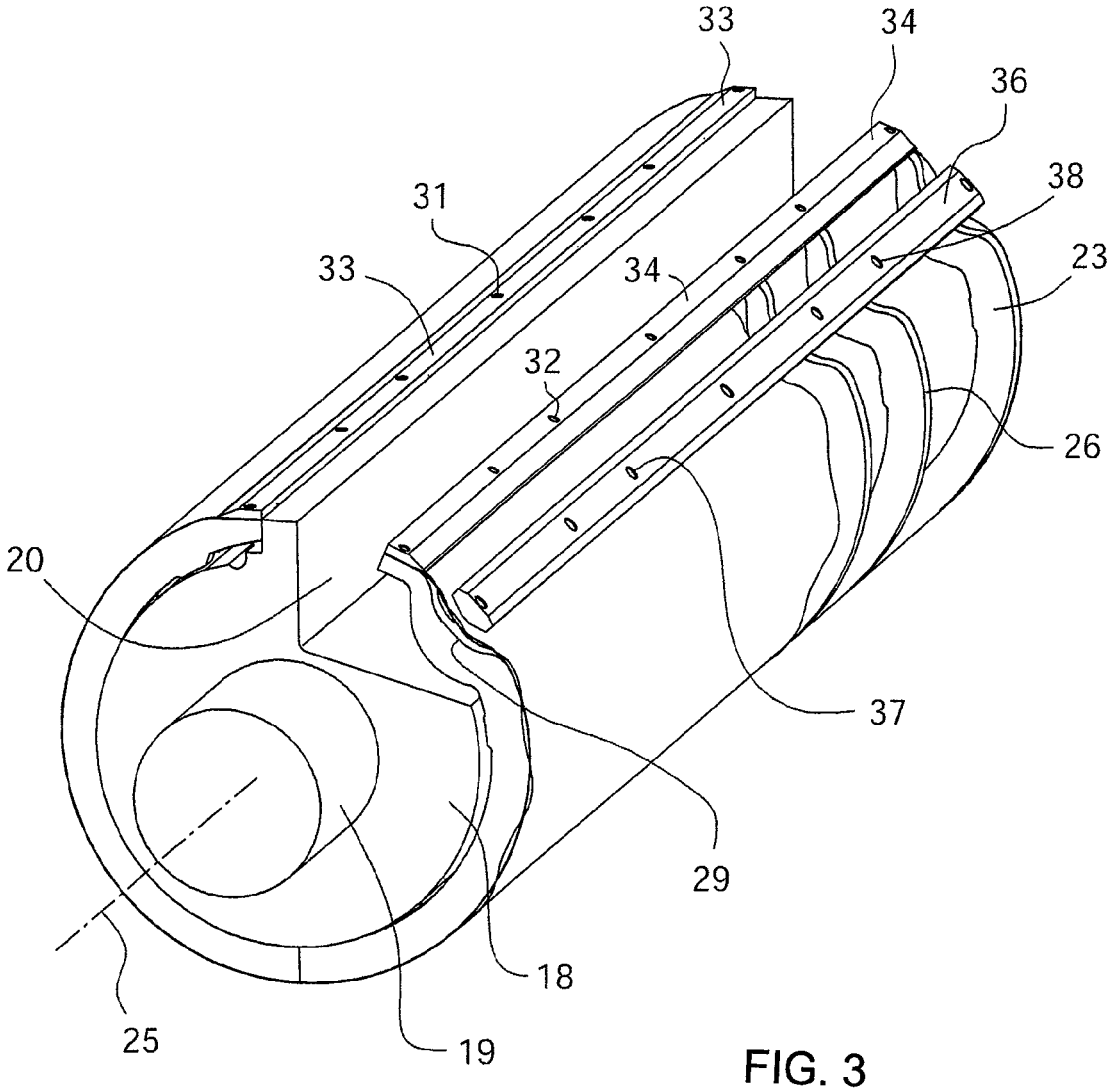

FIGS. 2 and 3 represent a sectional and a perspective view of the feed cylinder 7. The feed cylinder 7 is formed of a cast body 18. Journals 19 for mounting the cast body 18 to the side walls or frame of the sheet-fed printing press shown in FIG. 1 and a gap or channel 20 for accommodating the gripper system 17, are formed on the cast body 18. Among other parts, the gripper system 17 is formed of movable gripper fingers 21 and associated gripper pads 22. A device 41 actuates the gripper system 17. Ribs 23 are fastened to the cast body 18 through the use of screws 24 and form a drum body together with the cast body 18. As can be seen more clearly in FIG. 3, the ribs 23 are disposed equidistantly from each other and perpendicular to an axis of rotation 25. A drive 42 rotates the drum 7 about the longitudinal axis 25. The ribs 23 have narrow sides 26 that face outward and form support surfaces for a jacket or backing 27 made of spring steel. The ribs 23 have flattened portions 28 for the passage of the oscillating grippers 6 and cup-shaped depressions 29 that form a tensioning gap 30 as shown in FIG. 2. Each end of the jacket 27 is fixed to the ribs 23 through the use of screws 31, 32 and clamping bars 33, 34. The screws 31, 32 and the clamping bars 33, 34 are located below a contour 35 that results when the jacket 27 rotates about the axis 25. The gripper finger 21 is located outside the contour 35 in the radial direction. A tensioning bar 36 and tensioning screws 37 are provided for tensioning the jacket 27. The tensioning bar 36 extends across the width of the feed cylinder 7 and has bores 38 for the tensioning screws 37 to pass through. The tensioning screws 37 extend through elongated holes 39 in the jacket 27 and are screwed into threaded bores 40 formed in the ribs 23. A device for fixing the at least one jacket 27 onto the drum body 18, 23 is formed by the tensioning bar 36, the screws 37 and the bores 40. When the tensioning screws 37 are screwed into the threaded bores 40, the tensioning bar 36 is moved inward in a radial direction, so that the jacket 27 is pulled into the tensioning gap 30 against a retaining spring force. The jacket 27, including the depressions 29, rests on the narrow sides 26 of the ribs 23 in a tautened state. In the region of the tensioning gap 30, the jacket 27, the tensioning screws 37, and the tensioning bar 36 are below the contour 35.

The invention claimed is:

1. A drum for conveying a sheet, the drum comprising:

a drum body;

at least one jacket disposed above a gap and forming a circumferential surface;

support ribs extending in circumferential direction and formed on said drum body to support said at least one jacket, said gap being formed by depressions in said ribs;

at least one device for fixing said at least one jacket onto said drum body, said at least one device for fixing being radially adjustable and having at least one tensioning body acting on said at least one jacket in vicinity of said gap;

grippers for holding the sheet on said circumferential surface;

a device for actuating said grippers;

journals for mounting the drum in a frame; and a drive for rotating the drum about a longitudinal axis.

2. The drum according to claim 1, which further comprises at least one device, disposed on said drum body, for holding ends of said at least one jacket.

3. The drum according to claim 2, which further comprises a clamping device for one of said ends of said at least one jacket, said gap being formed in vicinity of said clamping device.

4. A drum for conveying a sheet, the drum comprising:

a drum body;

at least one jacket disposed above a gap and forming a circumferential surface;

a tensioning body formed as a tensioning profile extending across a width of said at least one jacket, and tensioning screws provided for radial adjustment, said tensioning screws extending through bores in said tensioning profile and in said at least one jacket;

at least one device for fixing said at least one jacket onto said drum body, said at least one device for fixing being radially adjustable and having at least one tensioning body acting on said at least one jacket in vicinity of said gap;

grippers for holding the sheet on said circumferential surface;

a device for actuating said grippers;

journals for mounting the drum in a frame; and a drive for rotating the drum about a longitudinal axis.

5. The drum according to claim 4, wherein said tensioning screws and said tensioning profile are disposed below a rotation contour of said at least one jacket.

6. A drum for conveying a sheet, the drum comprising:

a drum body;

at least one jacket disposed above a gap and forming a circumferential surface;

a tensioning body formed as a tensioning profile extending across a width of said at least one jacket, and tensioning screws provided for radial adjustment;

support ribs extending in circumferential direction and formed on said drum body to support said at least one jacket, said gap being formed by depressions in said ribs, and said tensioning screws being screwed into threaded bores in said ribs;

at least one device for fixing said at least one jacket onto said drum body, said at least one device for fixing being radially adjustable and having at least one tensioning body acting on said at least one jacket in vicinity of said gap;

grippers for holding the sheet on said circumferential surface;

a device for actuating said grippers;

journals for mounting the drum in a frame; and a drive for rotating the drum about a longitudinal axis.

7. The drum according to claim 6, wherein said tensioning screws and said tensioning profile are disposed below a rotation contour of said at least one jacket.

* * * * *